United States Patent [19]

Seymour et al.

[11] 4,297,663

[45] Oct. 27, 1981

[54] CIRCUIT BREAKER ACCESSORIES PACKAGED IN A STANDARDIZED MOLDED CASE

[75] Inventors: Raymond K. Seymour, Plainville; Frank H. Murphy, West Hartford, both of Conn.

[73] Assignee: General Electric Company, New York, N.Y.

[21] Appl. No.: 88,714

[22] Filed: Oct. 26, 1979

[51] Int. Cl.[3] ..... H01H 73/06; H01H 73/08

[52] U.S. Cl. ..... 335/20; 200/303; 335/202

[58] Field of Search ..... 335/20, 18, 14, 8, 9, 335/10, 132, 202; 200/303, 307, 330, 331

[56] References Cited

U.S. PATENT DOCUMENTS

| | | | |
|---|---|---|---|
| 3,636,482 | 1/1972 | Edmunds | 335/18 |
| 4,075,584 | 2/1978 | Castonguay et al. | 335/20 |
| 4,077,024 | 2/1978 | Lisnay | 335/10 |
| 4,097,831 | 6/1978 | Jencks et al. | 335/20 |
| 4,166,260 | 8/1979 | Gillette | 335/20 |

*Primary Examiner*—Harold Broome

*Attorney, Agent, or Firm*—Robert A. Cahill; Walter C. Bernkopf; Philip L. Schlamp

[57] ABSTRACT

Various circuit breaker accessories, such as a shunt trip, an undervoltage release, an auxiliary switch, and a bell alarm, are individually packaged in a standardized molded insulative accessory case for ultimate factory or even field installation in a molded case, automatic power circuit breaker.

8 Claims, 9 Drawing Figures

CIRCUIT BREAKER ACCESSORIES PACKAGED IN A STANDARDIZED MOLDED CASE

BACKGROUND OF THE INVENTION

The present invention relates to automatic power circuit breaker accessories and particularly to a universal packaging arrangement for the various types of accessory devices commonly utilized in power circuit breakers.

As electrical power distribution systems become more sophisticated, increasing demands are being placed on power circuit breakers to perform collateral functions in addition to their primay function of circuit protection. To this end, circuit breakers are equipped with a wide variety of accessory devices to accommodate these collateral functions. Thus, shunt trips are installed in power circuit breakers to accommodate tripping of the breaker from a remote location initiated manually or automatically in response to a condition not necessarily related to the currents flowing in the breaker poles. Accessory switches are installed in power circuit breakers to sense when the breaker is closed or open, and if open, whether it was manually opened or tripped open. The contacts of these accessory switches are wired into external circuits to effect indicating and control functions. To protect loads such as motors from possible damage due to low line voltage, circuit breakers are equipped with undervoltage releases (UVR) to trip the breaker in response to prolong low line voltage conditions.

In many installations, circuit breakers may be equipped with not one, but several of these accessory device. Particularly in the case of molded case power circuit breakers, the space available to accommodate these accessory devices is at a premium. Moreover, in the close confines of a molded circuit breaker case, isolating the accessory devices from live breaker parts is a signficant problem. For these reasons, plus the fact that the accessories are typically of different sizes and shapes calling for unique mounting provisions, circuit breaker accessories have traditionally been factory installed items. Thus installation of these accessory devices to add their collateral functions to circuit breakers in the field is typically not convenient and, in many instances, not UL approved.

It is accordingly an object of the present invention to provide a family of improved circuit breaker accessory devices.

A further object is to provide accessory devices of the above character wherein each accessory type is packaged in a standardized manner to greatly simplify their installation in power circuit breakers, both in the factory and in the field.

Yet another object is to provide accessory devices of the above character wherein each accessory type is packaged in a standardized insulative, molded case.

An additional object is to provide a family of molded case accessory devices of the above character which are uniformly compact in size, economical to fabricate and assemble, and reliable in operation.

Other objects of the invention will in part be obvious and in part appear hereinafter.

SUMMARY OF THE INVENTION

In accordance with the present invention, there is provided a family of accessory devices for installation in automatic power circuit breakers, particularly molded case circuit breakers. Each type of accessory device is packaged in a standardized insulative case molded in a suitable plastic material. The case is externally provided with universal mounting provisions accommodating installation of the accessory device to the circuit breaker in operational positions occupying available space in either of the two outside breaker pole regions. The accessory case is formed in two parts secured together to substantially enclose and isolate the accessory components from live breaker parts. Internally of the accessory case provisions are made for stationarily mounting accessory components and movable mounting one or more arms which protrude through a case opening for dispositioning in individual actuating relation with functional elements of the circuit breaker.

Thus, in the case of accessory switches, one or more normally open and/or normally closed switches are mounted within the accessory case and an arm is internally, pivotally mounted to actuate the switch or switches in response to movement of the breaker contacts to their open and closed positions or movement of a breaker operating mechanism latch to its tripped position.

For a shunt trip, a solenoid is mounted within the accessory case, together with a trip actuating arm, a reset arm and a latch lever. Upon energization of the solenoid, its plunger strikes the latch lever to release the trip arm for spring powered impacting engagement with a trip button carried by the circuit breaker trip mechanism. Depression of the trip button by the trip arm initiates tripping of the circuit breaker and the breaker contacts, in springing to their open circuit position, pick up the reset arm to reset the solenoid plunger and relatch the latch lever with the trip actuating arm.

An undervoltage release is constructed in a manner analogous to the shunt trip in that a solenoid, a trip actuating arm, a reset arm and a latch lever are mounted internally of the molded accessory case utilizing the same mounting provisions. Energization of the solenoid from normal line voltage holds its plunger seated and the latch lever linked thereto in its trip actuating arm latching position against the bias of a spring acting on the latch lever. The accessory case further includes means for facilitating adjustably calibrating this spring bias so as to establish the desired dropout voltage. When line voltage falls below the established dropout voltage, the spring overpowers the solenoid holding force and drives the latch lever to its unlatching position releasing the trip actuating arm to trippingly impact the trip button. The reset arm is then picked up by the breaker contacts moving to their open circuit position to reseat the solenoid plunger and return the latch lever and actuating arm to their latched positions.

The invention accordingly comprises the features of construction and arrangements of parts which will be exemplified in the constructions hereinafter set forth, and the scope of the invention will be indicated in the claims.

For a better understanding of the nature and objects of the invention, reference should be had to the following detailed description taken in conjunction with the accompanying drawings, in which.

Like reference numerals refer to corresponding parts throughout the several views of the drawings.

DETAILED DESCRIPTION

Figure 1:
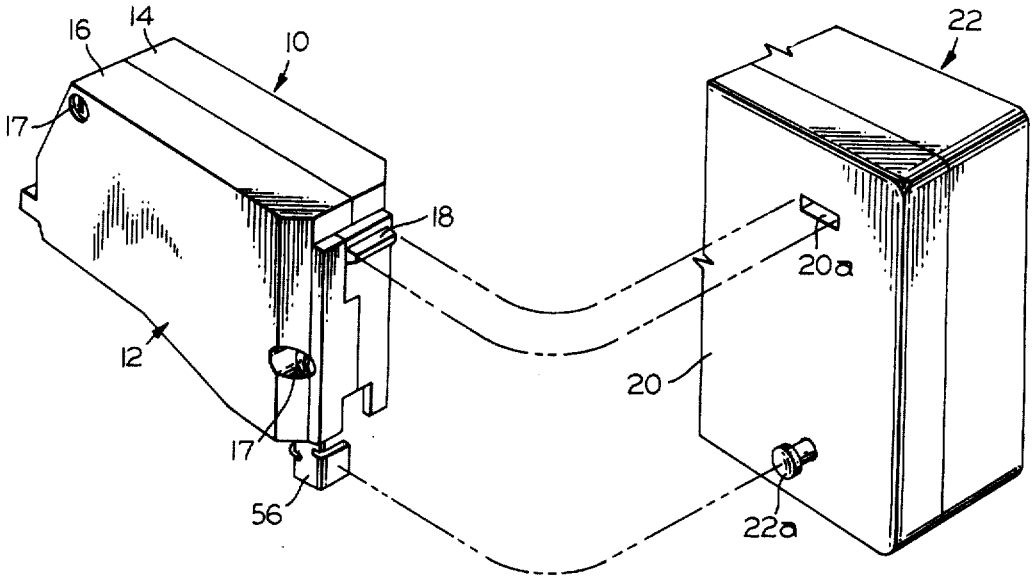
FIG. 1 is a perspective view of a molded case accessory device constructed in accordance with the present invention and depicts the preferred manner of mounting same in an automatic, electric power circuit breaker.
Figure 2:
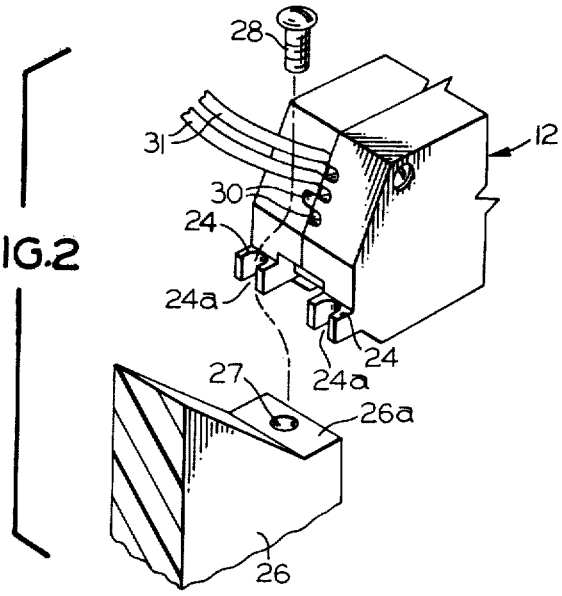
FIG. 2 is a fragmentary perspective view of the molded case accessory device of FIG. 1, further illustrating the manner of mounting same.

Referring to FIG. 1, an accessory device constructed in accordance with the present invention and generally indicated at 10, includes an insulative case, generally indicated at 12, molded in a suitable plastic, such as phenolic. The case is formed in two parts, a base 14 and a cover 16, secured together by suitable means, such as screws 17. To facilitate installation of the accessory device in an automatic electric circuit breaker, suitable mounting provisions are formed on the exterior of the molded case 12. In the illustrated embodiment, these exterior mounting provisions take the form of an integrally molded tongue 18 configured to fit into a groove or slot 20*a* provided in the housing 20 of a trip unit, generally indicated at 22, installed in the circuit breaker. At the opposite or rearward end of case 12 from tongue 18, there is integrally molded a pair of feet 24 best seen in FIG. 2, one of which, depending on whether the accessory device is installed in the right or left breaker pole region, rests on a ledge 26*a* formed in an interpole partition 26 molded into the base (not shown) of a molded case power circuit breaker. The partition is provided with a bore 27 into which a self-threading screw 28 is turned to clamp one of the feet 24 under the screw head. If desired, a groove 24*a* may be formed in each foot to accommodate the shank of the screw and thus increase the clamped foot surface area under the screw head. As also seen in FIG. 2, a series of notches 30 are provided in the abutting edges of a base and cover to admit external wiring 31 to the case interior.

Figure 3:
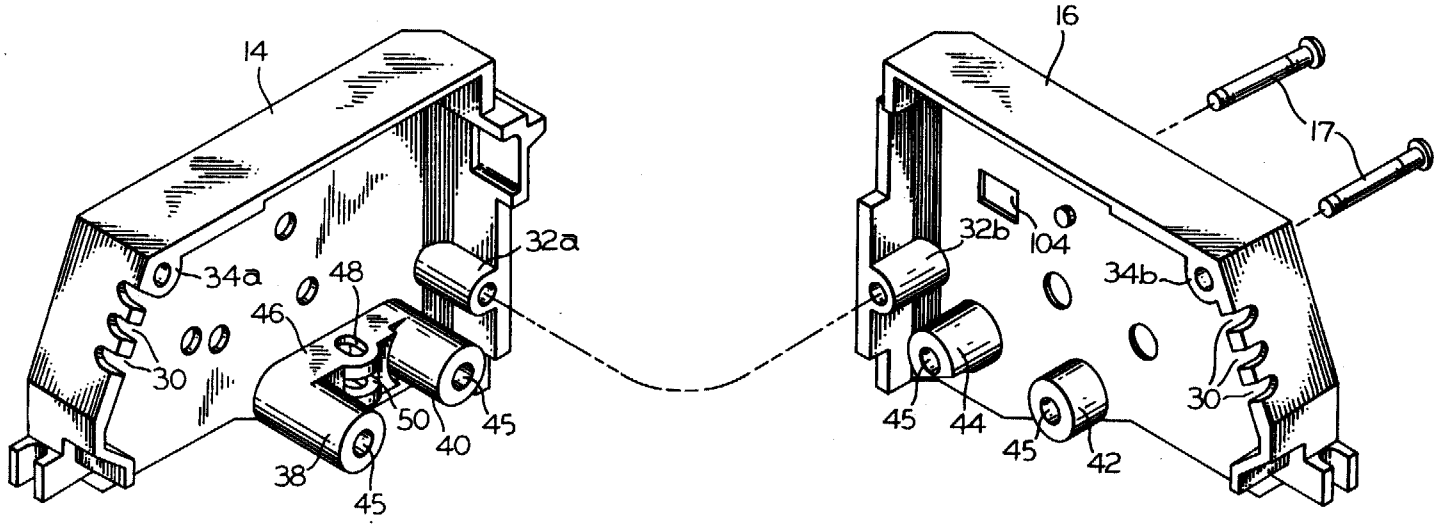
FIG. 3 is a perspective view of the interior of the base and cover constituting the molded accessory case of the present invention.

The interior molded configurations of the base 14 and cover 16 adapting case 12 to universally accommodate a family of accessory devices are seen in FIG. 3. Both the base and cover are seen to be of an essentially tray-like shape, each having a sidewall, corresponding shallow top, front and rear walls. Bottom walls are omitted from the base and cover to afford an elongated opening in case 12 accommodating the protrusion of various accessory operating components to be described. Aligned bosses 32*a* and 32*b* respectively molded into the front walls of the base and cover, together with aligned bosses 34*a* and 34*b* respectively molded into the corners of the top and rear walls of the base and cover, accommodate uniting screws 17. Specifically, these screws pass through clearance holes molded in bosses 32*b*, 34*b* and self-thread into blind bores molded in bosses 32*a*, 34*a* pursuant to securing the base and cover together. Molded in the base sidewall adjacent its bottom edge are a pair of mounting posts 38 and 40 which respectively align with mounting posts 42 and 44 molded in in the cover sidewall. A blind hole 45 is formed in each mounting post for the purpose of receiving the opposed ends of pins serving to pivotally mount various arms and levers seen in the accessory embodiments to be described. The heights of these mounting posts are such that, with the base and cover united, gaps are provided therebetween to accommodate the pivotal mounting of these arms and levers.

Still referring to FIG. 3, a flange 46 is molded in base 14 between mounting posts 38, 40. A vertical hole 48 is formed in this flange in intersecting relation with a cavity 50 to accommodate an adjustable spring anchor utilized in some of the accessory embodiments described in subsequent figures. The base and cover are further provided with an appropriate pattern of holes and/or knockouts utilized as stationary mounting provisions for the various switches and solenoids employed in these accessory embodiments.

Figure 4:
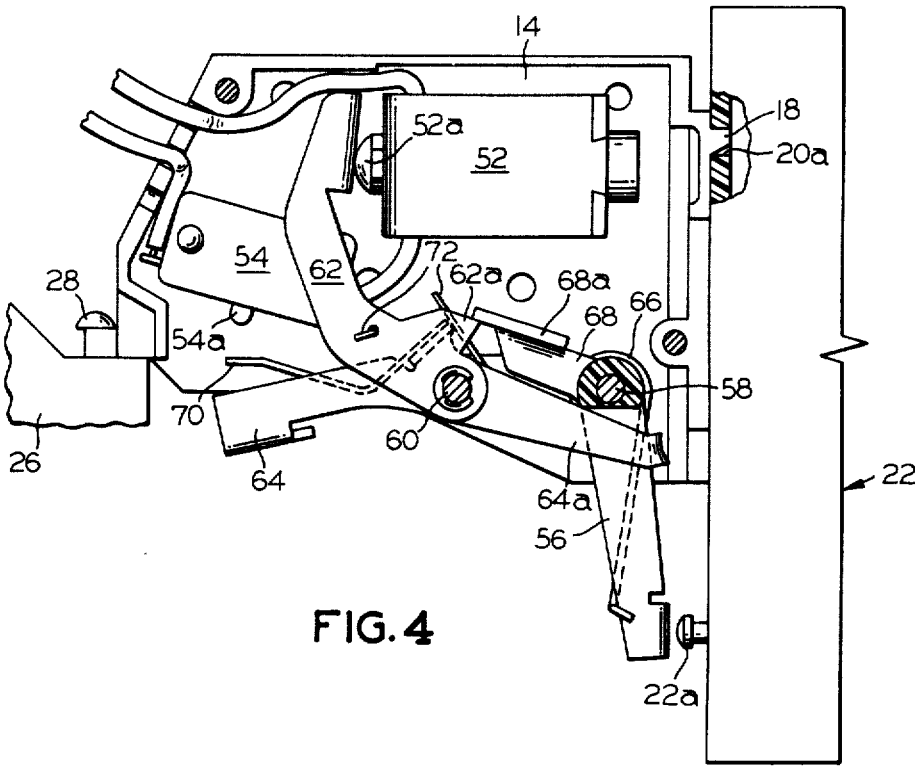
FIG. 4 is a side elevational view, with the case cover removed, of the shunt trip accessory embodiment of the present invention.
Figure 5:
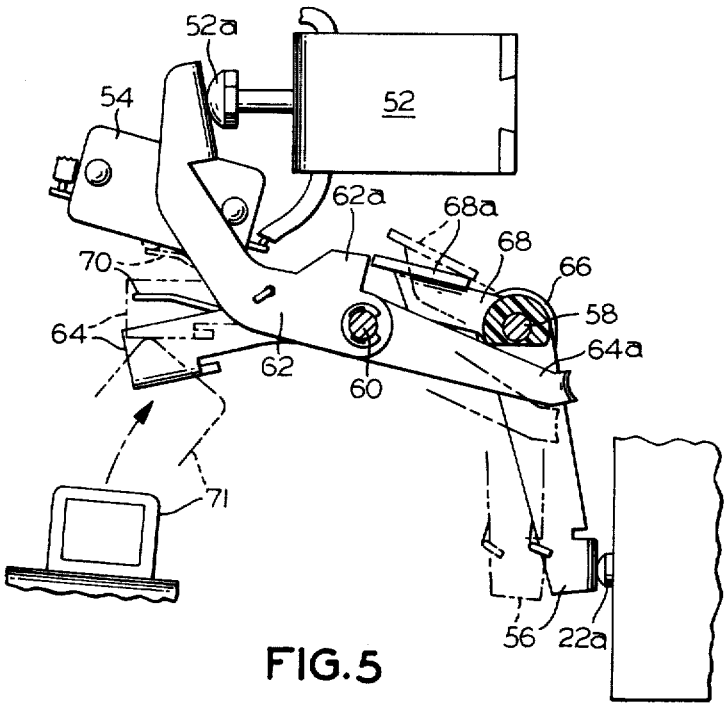
FIG. 5 is a side elevational view of the various parts of the shunt trip embodiment of FIG. 4 illustrating in solid line their shunt tripping positions.

FIGS. 4 and 5 disclose the shunt trip embodiment of the present invention wherein a solenoid 52 and a switch 54 are bolted or riveted to base 14 utilizing various holes and/or knockouts performed therein. A trip actuating arm 56 is pivotally mounted by a pin 58 captured in the aligned holes 45 in the base and cover mounting posts 40 and 44, respectively (FIG. 3). A pin 60, captured in the aligned holes 45 in base and cover mounting posts 38 and 42, respectively, serves to pivotally mount a latch lever 62 and a reset arm 64. A torsion spring 66, carried by mounting post 40, biases trip actuating arm 57, protruding through the open bottom of accessory case 12, in the counter-clockwise direction to swing its laterally turned lower end portion into impacting engagement with a trip button 22*a* of circuit breaker trip unit 22. Depression of this button by arm 56 initiates tripping of the breaker contacts (not shown) to their open circuit position. Integrally formed with trip actuating arm 56 is a latch arm 68 which carries a laterally turned flange 68*a* seen in FIG. 4 to be latchingly engaged by a nose 62*a* carried by latch lever 62. Thus, with these components in the positions shown in FIG. 4, latch lever 62 latchingly sustains trip actuating arm 56 in its quiescent position in disengaged relation with trip button 22*a* against the bias of spring 66.

When an actuating potential is applied to the energization circuit for solenoid 52, which is wired through normally closed switch 54, the solenoid plunger 52*a* is driven to its extended position seen in FIG. 5, and latch lever 62 is pivoted by the plunger in the counter-clockwise direction to unlatch trip actuating arm 56. Spring 66 discharges to drive arm 56 into impacting engagement with trip button 22*a*, and the consequent depression thereof precipitates tripping of the circuit breaker. As the breaker movable contacts spring to their open circuit position, the crossbar 71 or one of the movable contact carriers tied together by the crossbar picks up and pivots reset arm 64 in the clockwise direction, as seen in FIG. 5. An integral extension 64*a* of this reset arm has a laterally turned termination disposed to pick up and pivot trip actuating arm 56 to an extreme clockwise position, seen in phantom in FIG. 5, sufficient to elevate flange 68*a* above nose 62*a* of latch lever 62. Also carried by reset arm 64 is a resilient switch actuating arm 70 which swings into depressing engagement with actuating button 54*a* of switch 54 as the reset arm is pivoted to and held in its extreme clockwise position by the breaker movable contacts in assuming their tripped open position. Consequent actuation of switch 54 opens the solenoid energization circuit to allow a torsion spring 72, carried on mounting post 38 (FIG. 3), to return latch lever 62 to its clockwise-most reset position, in process retracting plunger 52*a* and swinging nose 62*a* into latchingly intercepting relation with the still elevated flange 68*a* of trip actuating arm 56. When the circuit breaker is subsequently closed, reset arm 64 is released, and spring 66 swings the trip actuating arm through an increment of counter-clockwise motion arrested short of impacting trip button 22*a* by latching engagement of latch lever nose 62*a* with flange 68*a*. Torsion spring 72 additionally acts on reset lever 64 to insure that it assumes a counter-clockwise-most reset position sufficient to swing switch actuating arm 70 out of engagement with actuating button 54*a* of switch 54. The contacts of this switch reclose to arm the solenoid energization circuit for the next shunt tripping operation.

Figure 6:
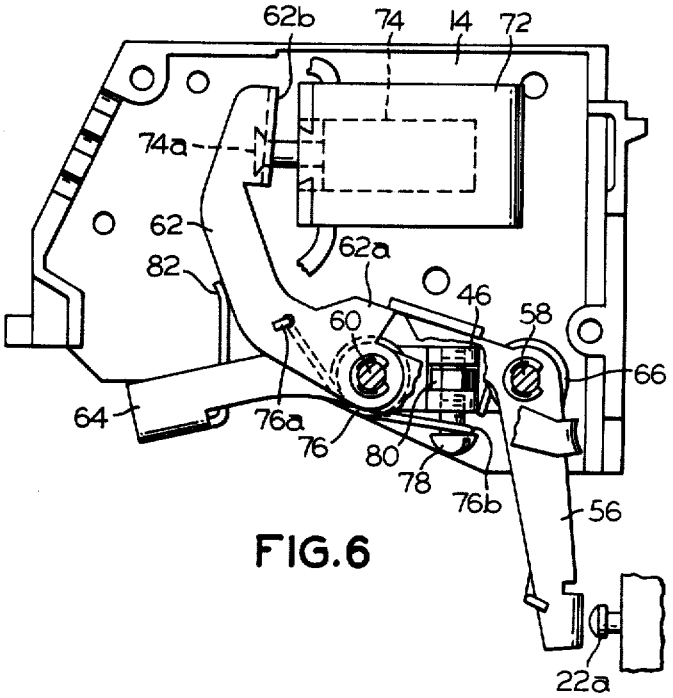
FIG. 6 is a side elevational view, with the case cover removed, of the undervoltage release embodiment of the present invention.

FIG. 6 illustrates an undervoltage release (UVR) as accommodated in accessory case 12. The trip actuating arm 56, the pivotal mounting thereof, and its torsion spring 66 may be and preferably are all the same as in the shunt trip accessory embodiment just described. A UVR solenoid 72 is bolted or riveted to base 14 using appropriate holes and/or knockouts performed therein. Latch lever 62 may virtually be the same as in the shunt trip version, except that the UVR solenoid plunger 74 is provided with a headed termination 74*a* which engages the back side of a laterally turned flange 62*b* carried at the upper end of the latch lever. A torsion spring 76 is carried on mounting post 38 with one end 76*a* hooked to latch lever 62 and another end 76*b* hooked under the head of a calibrating screw 68 whose shank extends upwardly through hole 48 and threads through a nut 80 accommodated in cavity 50 (FIG. 3). The UVR solenoid is wired across points in the distribution circuit so as to be energized by line voltage. With plunger 74 properly seated, the electromagnetic force developed by the UVR solenoid under normal line voltage overpowers spring 76 to maintain latch lever 62 in latching engagement with trip actuating arm 56. If the line voltage falls to an abnormal level, spring 76 can then overpower the reduced solenoid electromagnetic force, whereupon the latch lever is pointed in the counter-clockwise direction to unlatch the trip actuating arm for impacting engagement with trip button 22*a* under the urgence of spring 66. Turning of calibrating screw 78 adjusts the force of spring 76 to establish the desired undervoltage trip level. As the breaker movable contacts spring to their tripped open positions, reset arm 64, as in the shunt trip version, is picked up and pivoted in the clockwise direction, in the process resetting the trip actuating arm. Since the space occupied by the latch layer reset spring 74 (FIG. 4) in the shunt trip version is taken up by spring 76 in the UVR version, a resilient finger 82, carried by the reset lever, is utilized to reset the latch lever and positively reseat plunger 74 against the bias of UVR spring 76. Assuming the return of normal line voltage when the breaker contacts are reclosed, the trip actuating arm is sustained in its latched position by the latch lever.

Figure 7:
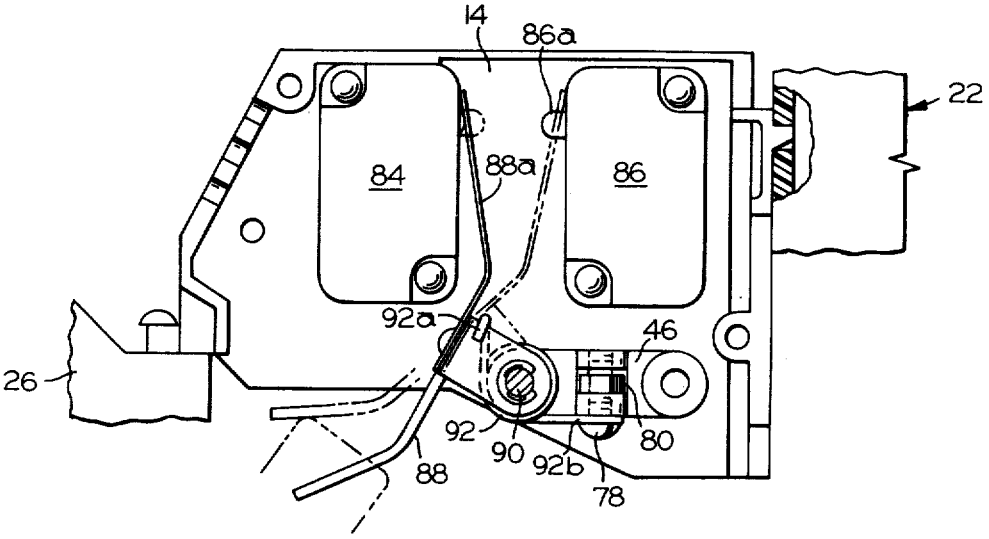
FIG. 7 is a side elevational view, with the case cover removed, of the auxiliary switch embodiment of the present invention.

FIG. 7 shows the accessory of the present invention embodied as an auxiliary switch. Thus, there are illustrated switches 84 and 86 mounted to base 14 via bolts or rivets using appropriate, preformed holes and/or knockouts seen in FIG. 3. Actually, the width of accessory case 12 may be made sufficient to mount pairs of switches 84 and 86 in ganged, side-by-side relation, to provide a total of four normally open or normally closed switches. A switch actuating arm 88 is pivotally mounted on a pin 90 captured in the aligned holes 45 in mounting posts 38 and 42 best seen in FIG. 3. A torsion spring 92 is carried by mounting post 38 with one end 92*a* hooked on arm 88 and another end 92*b* anchored under the head of screw 78. In this accessory embodiment no calibration of the spring force is required, and thus screw 78 may be simply turned down to securely clamp spring end 92*b* against the bottom surface of flange 46. Spring 92 biases arm 88 to its solid line position of FIG. 7 to dispose a resilient finger extension 88*a* thereof in switch actuating engagement with a button 84*a* of switch 84 as long as the circuit breaker is closed. It will be appreciated that the width of finger 88*a* may be made sufficient to actuatingly engage buttons of two switches ganged together in the left mounting position. When the circuit breaker is either manually opened or tripped open, the movable contacts pick up and pivot switch actuating arm 88 to its phantom line position with its resilient finger in actuating engagement with the button or buttons 86*a* of the switches installed in the right hand mounting position. The wiring for the switches 86 may be brought out through a knockout in the front wall of either the case or cover rather than through notches 30 (FIG. 2). When the circuit breaker is reclosed, spring 92 biases arm 88 to its solid line position with finger 88*a* actuating the switch or switches in the left hand mounting position. Obviously, the auxiliary switch accessory of FIG. 7 may comprise just a single normally open or normally closed switch installed in either the left or the right hand mounting position.

Figure 8:
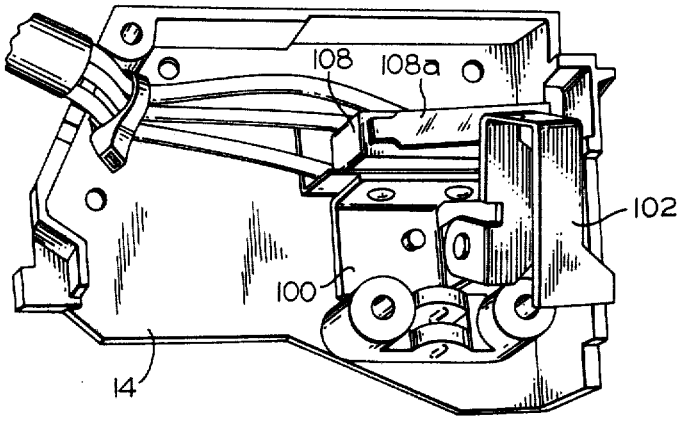
FIG. 8 is a perspective view, with the case cover removed, of the bell alarm embodiment of the present invention.
Figure 9:
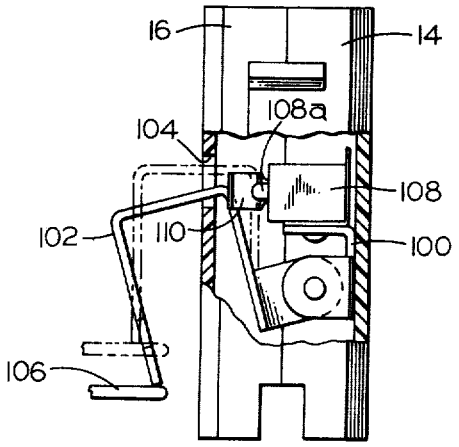
FIG. 9 is an end view, partially broken away, of the bell alarm accessory embodiment of FIG. 7.

FIGS. 8 and 9 illustrate the present invention embodied in a bell alarm accessory. A bell alarm is utilized to provide a signal only when the circuit breaker in which it is installed is tripped open. This is contrasted with the auxiliary switch embodiment of FIG. 7, wherein a signal is provided when the circuit breaker is opened, regardless of whether it was tripped open or mutually opened. Thus to distinguish between the two situations, a bell alarm must sense the condition of the circuit breaker trip latch. To this end, as seen in FIGS. 8 and 9, a bracket 100 is secured in base 14, again view screws or rivets and appropriate ones of the molded holes and/or knockouts preformed in the base. This bracket, in turn, pivotally mounts an inverted U-shaped arm 102 which extends upwardly through the case interior and then laterally through a knockout opening 104 (FIGS. 3 and 9) created in cover 16. The free end portion of this arm extends downwardly along the case exterior to dispose the arm termination in position to sense the condition of the circuit breaker trip latch. For the sake of simplicity, a pin 106 is illustrated in FIG. 9 as being an extension of the trip latch (not shown) and movable therewith between a solid line latching position and a phantom line tripping position.

Also mounted by bracket 100 is a normally open microswitch 108 which in turn mounts a leaf spring 110 in actuating relation with the switch actuating button 108*a*. Leaf spring 110 also biases arm 102 to its counter-clockwise-most solid line position seen in FIG. 9. When the circuit breaker is tripped, the circuit breaker latch, in assuming its tripping position, elevates pin 106 to its phantom line position, thereby picking up and swinging arm 102 in the clockwise direction to its phantom line position. The arm, in turn, engagingly swings leaf spring 110 into depressing engagement with switch actuating button 108*a*. The contacts of switch 108 close to complete an external bell alarm circuit providing a suitable signal indication that the circuit breaker has been tripped down. When the breaker mechanism is reset, the breaker latch reassumes its latching position, and arm 102 is returned to its solid line position under the bias of leaf spring 110.

From the foregoing description, it is seen that molded accessory case 12 is uniquely structured to universally mount and substantially, insulatively enclose any one of a whole family of circuit breaker accessory devices. Mounting of the accessory devices in a circuit breaker is greatly facilitated by the expedient mounting provisions provided on the case exterior, so much so that accessory field installation becomes a viable alternative.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described our invention, what we claim as new and desired to secure by Letters Patent is:

1. An accessory for installation within the molded case enclosure of an automatic electric circuit breaker, said accessory comprising, in combination:

A. a molded insulative case consisting of at least two parts secured together to substantially enclose the accessory operating components;

B. first mounting provisions provided externally on said case for mounting said accessory within the circuit breaker enclosure;

C. second mounting provisions preformed in said case parts;

D. third mounting provisions preformed in said case parts;

E. at least one auxiliary swtich stationarily mounted by said second mounting provisions within said case; and F. an actuating arm for said switch mounted within said case by said third mounting provisions for movement between said first and second positions, said arm protruding through an opening in said case into operative relation with the movable contacts of the circuit breaker, said arm being propelled between its first and second positions in response to movement of the breaker movable contacts between their open and closed circuit positions.

2. An accessory for installation within the molded case enclosure of an automatic electric circuit breaker, said accessory comprising, in combination:

A. a molded insulative case consisting of at least two parts secured together to substantially enclose the accessory operating components;

B. first mounting provisions provided externally on said case for mounting said accessory within the circuit breaker enclosure;

C. second mounting provisions preformed in said case parts;

D. third mounting provisions preformed in said case parts;

E. a shunt trip solenoid and a solenoid energizing circuit arming switch stationarily mounted within said case by said second mounting provisions; and F. a trip actuating arm, a latch lever and a reset arm all movably mounted within said case by said third mounting provisions, (1) said trip actuating arm protruding through an opening in said case into operative relation with a trip initiating element of the circuit breaker, (2) said latch lever positioned for actuation by said trip solenoid to release said trip actuating arm from a latch position, and (3) said reset arm protruding through said case opening into operative relation with the movable contacts of the circuit breaker and acting to return said trip actuating arm to its latched position in response to opening movement of the breaker movable contacts; and G. a spring biasing said trip actuating arm from its latched position into trip initiating engagement with the circuit breaker trip element.

3. The accessory device defined in claim 2, wherein said spring is mounted by an element of said third mounting provisions.

4. An accessory for installation within the molded case enclosure of an automatic electric circuit breaker, said accessory comprising, in combination:

A. a molded insulative case consisting of at least two parts secured together to substantially enclose the accessory operating components;

B. first mounting provisions provided externally on said case for mounting said accessory within the circuit breaker enclosure;

C. second mounting provisions preformed in said case parts;

D. third mounting provisions preformed in said case parts;

E. an undervoltage release solenoid stationarily mounted within said case by said second mounting provisions;

F. a trip actuating arm, a latch lever and a reset arm all movably mounted within said case by said third mounting provisions, (1) said trip actuating arm protruding through an opening in said case into operative relation with a trip initiating element of the circuit breaker, (2) said latch lever controllably coupled with said undervoltage release solenoid for releasably sustaining said trip actuating arm in a latched position, and (3) said reset arm protruding through said case opening into operative relation with the movable contacts of the circuit breaker and acting to return said trip actuating arm to its latched position in response to opening movement of the breaker movable contacts;

G. a first spring biasing said trip actuating arm from its latched position into trip initiating engagement with the breaker trip initiating element; and H. a second spring acting on said latch lever in opposition to the electromagnetic force developed by said solenoid.

5. The accessory device defined in claim 4, wherein said first and second springs are mounted by elements of said third mounting provisions.

6. The accessory device defined in claim 5, wherein one of said case parts includes preformed means accepting a calibrating screw for adjustably varying the anchoring point of said second spring, thereby to selectively establish the force of said second spring acting in opposition to said solenoid electromagnetic force.

7. A family of accessory devices for installation within the molded case enclosure of an automatic electric circuit breaker, each accessory device including, in combination:

A. a molded insulative case consisting of at least two parts secured together to substantially enclose the accessory device operating components;

B. first mounting provisions provided externally on said case for mounting said accessory device within the circuit breaker enclosure;

C. second universal mounting provisions preformed in said case parts for stationarily, internally mounting at least one of a variety of stationary accessory device components, said second mounting provisions including a pattern of holes and/or knockouts preformed in at least one of said case parts to accept fastener elements securing the stationary mounted accessory component in place; and D. third universal mounting provisions preformed in said case parts for movably, internally mounting at least one of a variety of movable accessory device components in operative relation with the stationarily mounted accessory component and protruding through an opening in said case into operative relation with a functional element of the circuit breaker, wherein said third mounting provisions include (1) at least one mounting post preformed in each case part, said mounting posts being in opposed, spaced relation when said case parts are secured together, and (2) aligned, blind holes respectively preformed in said opposed mounting ports for the acceptance of opposed end portions of a pivot pin pivotally mounting the movable accessory device component.

8. An accessory for installation within the molded case enclosure of an automatic electric circuit breaker equipped with a trip unit stationed within the breaker enclosure and operative in tripping the breaker to its open circuit condition, said accessory comprising, in combination:

A. a molded insulative case consisting of at least two parts secured together to substantially enclose the accessory operating components;

B. external means provided on said case for mounting the accessory within the circuit breaker enclosure;

C. an actuating arm;

D. a bell alarm switch; and

E. internal means provided in said case movably mounting said arm for protrusion through an opening in said case into operative relation with a circuit breaker trip latch and for stationarily mounting said bell alarm switch for actuation by said arm in response to movement of the latch to its circuit breaker tripping position.

* * * * *